United States Patent [19]

Ohba et al.

[11] 4,404,723

[45] Sep. 20, 1983

[54] APPARATUS FOR TAKING OFF A BAND WOUND ABOUT A PAPER SHEET BUNDLE

[75] Inventors: Hiroshi Ohba, Tokyo; Shigeo Horino, Oizumi, both of Japan

[73] Assignee: Tokyo Shibaura Denki Kabushiki Kaisha, Kawasaki, Japan

[21] Appl. No.: 261,936

[22] Filed: May 8, 1981

[30] Foreign Application Priority Data

May 12, 1980 [JP] Japan ..... 55-62414
May 12, 1980 [JP] Japan ..... 55-62416

[51] Int. Cl.[3] ..... B23D 15/04

[52] U.S. Cl. ..... 29/33.52; 29/56.5; 83/176; 83/909; 225/103

[58] Field of Search ..... 29/33.52, 56.5; 83/176, 83/909, 14; 30/2; 225/103

[56] References Cited

U.S. PATENT DOCUMENTS 3,377,687 4/1968 De Chellis ..... 29/56.5
3,513,522 5/1970 Thomson ..... 29/56.5 X
3,643,313 2/1972 Dickinson ..... 29/56.5 X
4,219,914 9/1980 Bartzick et al. ..... 29/56.5
4,328,609 5/1982 Born ..... 83/909 X

FOREIGN PATENT DOCUMENTS 2729830 1/1979 Fed. Rep. of Germany ..... 29/56.5

*Primary Examiner*—William R. Briggs
*Attorney, Agent, or Firm*—Cushman, Darby & Cushman

[57] ABSTRACT

A band-removing apparatus for taking off a band wound about a paper sheet bundle. One end portion of a paper sheet bundle brought to a band-removing section by transport means is clamped in a vertical direction by a pair of clamping members, thereby causing the paper sheet bundle to be bent downward. Part of a band is stretched over the concave portion of the bent paper sheet bundle in the form of a chord. A hooking member catches said chord portion of the band. When the hooking member holding said chord portion of the band is rotated crosswise of the transport passage, then the band is pulled off from the paper sheet bundle. The removed band is let to fall into a receptacle disposed on one lateral side of the transport passage.

12 Claims, 7 Drawing Figures

APPARATUS FOR TAKING OFF A BAND WOUND ABOUT A PAPER SHEET BUNDLE

This invention relates to an apparatus for taking off a band wound about a bundle of paper sheets such as bank notes or securities.

Recently, paper sheet-handling organizations such as banks are provided with an apparatus for classifying paper sheets, for example, bank notes or securities in accordance with the type, denomination or physical conditions, that is, according to whether these paper sheets retain the normal condition or are damaged, collecting the classified paper sheets in a prescribed number, and thereafter fastening them with a narrow band generally made of paper.

Band-fastened paper sheet bundles are transmitted between the city banks or other money-handling organizations. In this case, the receiving organizations have to take off fastened bands in order to count the number of paper sheets of the respective bundles or judge whether the received paper sheets retain the normal physical condition or are damaged.

Hitherto, the work of taking off fastened bands and supplying released paper sheets to a physical condition-judging apparatus has generally been manually carried out by a clerk. To date, therefore, various difficulties have occurred that a certain limitation is imposed on the band-handling efficiency of a clerk; the possibility may arise appreciably often that paper sheets are lost by the mistakes of the clerk; and in such case the responsible clerk and any other related clerks are forced to carry out the troublesome work of tracing the cause of said loss.

To resolve, therefore, the above-mentioned difficulties accompanying the manual band-handling of a clerk, demand has been made to develop an automatic band-removing apparatus, which, when receiving band-fastened paper sheet bundles supplied by a clerk, automatically takes off the fastened band, discharges unfastened paper sheet bundles in succession, and conducts the discharged paper sheet bundles to the succeeding step of, for example, judging the normal or damaged condition of the respective paper sheets.

The above-mentioned type of band-removing apparatus is already proposed in the West German laid-open patent application (DE-OS) No. 2,729,830. With the band-removing apparatus of said West German laid-open patent application, a band wound about a paper sheet bundles brought to a band-removing position is adsorbed to a pair of upper and lower suction means in a state stretched crosswise of said band-removing apparatus. A pair of endless belts are provided above and below a paper sheet bundle to clamp both lateral edges thereof, thereby pulling the paper sheet bundle out of the band.

It is accordingly the object of the invention to provide a band-removing apparatus which can take off a band wound about a paper sheet bundle smoothly and unfailingly, and allows for the easy transfer of the released paper sheet bundle to the succeeding judging step.

To attain the above-mentioned object, this invention provides a band-removing apparatus which first causes a paper sheet bundle brought to a band-removing section to be bent in the arcuate form around the lengthwise axis of the paper sheet bundle, thereby slightly loosening the paper sheet bundle from the band, in other words causing part of the band to be stretched over the concave portion of the bent paper sheet bundle in the form of, for example, a chord, and wherein means for taking off the band is engaged with the chord portion of the band, and the band is pulled lengthwise of the paper sheet bundle or the chord portion of the band is cut off, and, in the case where the chord portion of the band is cut off, then said cutoff portion is sucked by a suction pipe to be carried away from the paper sheet bundle.

The band-removing apparatus of this invention arranged as described above has the advantages that when a paper sheet bundle is arcuately bent, the tension with which a band is wound about the paper sheet bundle is reduced to facilitate the removal of a band therefrom; the arcuate bending of the paper sheet bundle causes part of the band to be stretched over the concave portion of the bent paper sheet bundle in the form of a chord; the chord portion of the band is widely separated from the bottom of the concave portion of the bent paper sheet bundle, thereby enabling a hooking or knifing member to easily catch the chord portion of the band in order to take off or cut off the band.

This invention can be more fully understood from the following detailed description when taken in conjunction with the accompanying drawings, in which.

Figure 1:
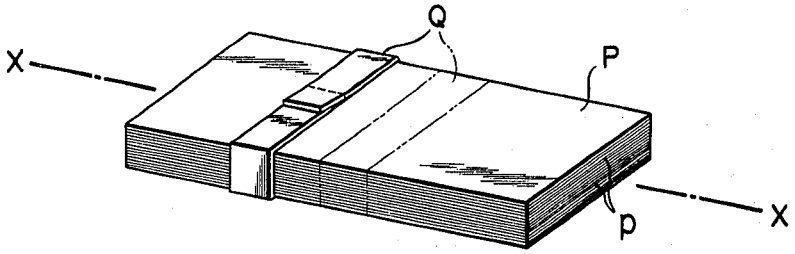
FIG. 1 PRIOR ART
FIG. 1 is an oblique view of an example of a paper sheet bundle fastened by a band which is to be taken off by a band-removing apparatus embodying this invention.

FIG. 1 illustrates a paper sheet bundle P fastened by a band Q. The paper sheet bundle P may be formed of various types of paper sheets p such as bank notes or securities. In the first embodiment, the paper sheet bundle P is taken to consist of bank notes. As shown in FIG. 1, paper sheets p are generally superposed on each other in a prescribed number of, for example, 100 to constitute a paper sheet bundle P. The band Q is wound crosswise of a direction X—X of the paper sheet bundle P. Both ends of the band Q are pasted together. The band Q is generally wound about the paper sheet bundle P along a crosswise line (a solid line) drawn slightly nearer toward one of the lengthwise ends of the paper sheet bundle P instead of along a central crosswise line (a 2 dots-dash line). A band-removing apparatus of this invention can take off a band, even if its position is somewhat displaced from the above-mentioned generally accepted position (a solid line position), provided the band itself is of the ordinary type.

Figure 2:
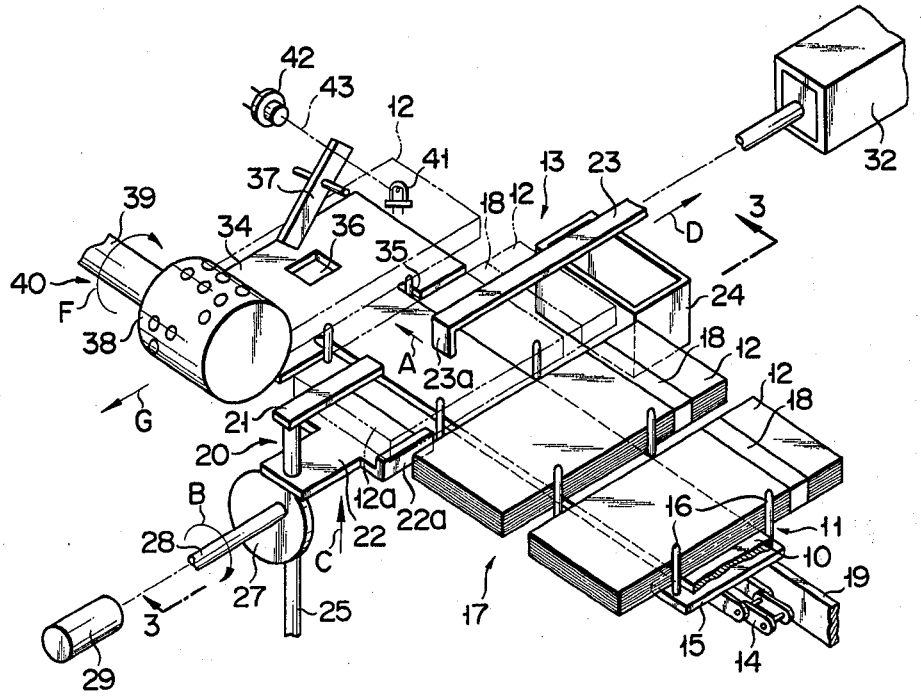
FIG. 2 is a schematic oblique view of a band-removing apparatus according to a first embodiment of this invention.

With a band-removing apparatus according to a first embodiment of this invention (FIGS. 2 to 5), a plurality of spatially arranged paper sheet bundles 12 travel along a transport passage 11 defined by an elongate flat metal guide board 10 in a direction indicated by an arrow A with the lengthwise axis of said paper sheet bundles 12 set at right angles to the transport passage 11. The metal guide board 10 remains stationary, and its leading end terminates at a point a little beyond a band-removing section 13. A transport mechanism is provided along the underside of the guide board 10. This transport mechanism consists of an endless drive chain 14 and a plurality of narrow support brackets 15 which are spatially arranged and extend to both lateral sides of said endless drive chain 14. Only one bracket 15 is shown in FIG. 2. The endless drive chain 14 (partly indicated) is moved backward substantially at the same point as the leading end of the guide board 10. As shown in FIG. 2, a plurality of spatially arranged pairs of paper sheet bundle-feeding pins 16 are elastically erected along both lateral edges of the respective brackets 15. Each pair of pins 16 intermittently pushes the corresponding paper sheet bundle 12 in the direction of the indicated arrow A. The manner in which the bracket 15 and feeding pins 16 are coupled together is already known, their detailed drawing being omitted. The above-mentioned guide board 10, brackets 15, endless drive chain 14 and plural pushing pins 16 jointly constitute transport means 17 for carrying the respective paper sheet bundles 12 to the band-removing section 13. The respective brackets 15 are guided by a stationary guide bar 19 extending along the transport passage 11, thereby being prevented from being displaced from a horizontal position.

The band 18 fastening each paper sheet bundle 12 lies beyond one of the lateral edges of the guide board 10 as viewed crosswise thereof.

In the band-removing section 13, a bending mechanism 20 provided with a pair of clamping members 21, 22 is set on one side of the guide board 10. A band-removing hooking member 23 and band receptacle 24 are provided on the opposite side of the guide board 10.

Figure 3:
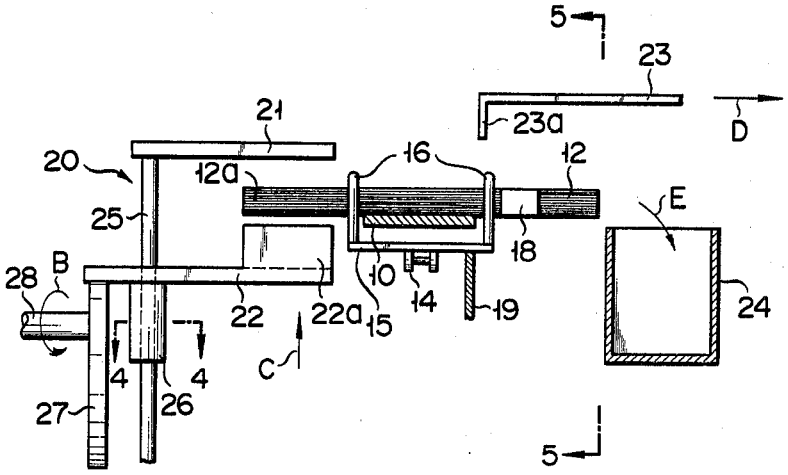
FIG. 3 is a cross sectional view on line 3—3 of FIG. 2.

As seen from FIG. 2 one movable clamping member 22 faces the underside of one end portion 12*a* of the foremost paper sheet bundle 12 brought to the band-removing section indicated in a 2 dots-dash line. The clamping member 22 has two projections 22*a*, 22*b* set up along part of both lateral edges, and is shaped like a fork or takes a U-shape as a whole when viewed vertically. A sleeve 26 is slidably engaged with a fixed vertical shaft 25 (FIG. 3). A space between the two projections 22*a*, 22*b* is made slightly smaller than the width of the paper sheet bundle 12. The outer end of the movable clamping member 22 is fitted with an eccentric cam 27. This cam 27 is rotated with a horizontally extending shaft 28 in a vertical plane. The shaft 28 is connected to a drive motor 29. The selective clockwise rotation of the shaft 28 in the direction of an indicated arrow B resulting from the drive of the motor 29 leads to the similar clockwise rotation of the eccentric cam 27, thereby causing the clamping member 22 to be reciprocated between the lowermost released position (FIGS. 2 and 3) and the uppermost pressed position (FIG. 5).

The other clamping member 21 is constituted by a bar horizontally extending from the vertical fixed shaft 25 to face the aforesaid one end portion 12*a* of the paper sheet bundle 12 from above. The bar-shaped clamping member 21 lies intermediate between the two projections 22*a*, 22*b* of the previously described fork-shaped or U-shaped clamping member 22. Said other clamping member 21 remains immovable.

Figure 4:
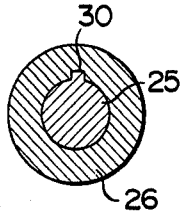
FIG. 4 is an enlarged view on line 4—4 of FIG. 3.

As seen from FIG. 4, the stationary shaft 25 and sleeve 26 are connected together by means of a key-keyway mechanism 30. Therefore, the sleeve 26 can slide vertically along the fixed shaft 25, but is prevented from being rotated.

Figure 5:
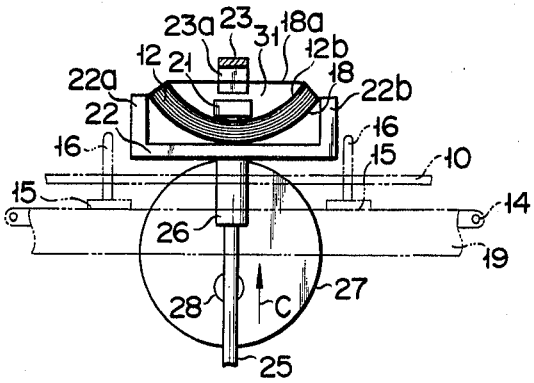
FIG. 5 is a schematic fractional view on line 5—5 of FIG. 3.

Where, as shown in FIG. 5, the rotation of the eccentric cam 27 causes the lower movable clamping member 22 to be lifted in the direction of an indicated arrow C up to the clamping position, then the two projections 22*a*, 22*b* of said lower clamping member 22 are pressed against the underside of both near edge portions of one end portion 12*a* of the paper sheet bundle 12 to push it up. As a result, the central part of said one end portion of the paper sheet bundle 12 is pressed against the underside of the upper bar-shaped clamping member 21. Consequently, the paper sheet bundle 12 is clamped between the upper and lower clamping members 21, 22 in an apparently floating state. Therefore, the paper sheet bundle 12 is bent downward to define a concave portion within. Since, at this time, the band 18 wound about the paper sheet bundle 12 does not undergo the clamping force of the upper and lower clamping members 21, 22, part of said band 18 is stretched over the concave portion 12*b* of the downward bent paper sheet bundle 12 in the form of a chord 18*a*, thus defining a broad space 13 between the chord portion 18*a* of the band 18 and the bottom of the concave portion 12*b* of the downward bent paper sheet bundle.

Under the above-mentioned condition, the chord portion 18*a* of the band 18 lies within the locus of the movement of a hook 23*a* provided at the free end of the hooking member 23 horizontally slidable crosswise of the traveling direction A (FIG. 2) of the paper sheet bundle 12.

When the hooking member 23 is retracted in the direction of an indicated arrow D from the advanced position shown in FIGS. 2 and 3, then the hook 23*a* catches the chord portion 18*a* of the band 18 to pull off the band 18 from the paper sheet bundle 12 along its lengthwise axis. The pulled-off band 18 is let to fall in the direction of an indicated arrow E (FIG. 3) into the receptacle 24 set exactly below the band-removing section 13.

The bending of the paper sheet bundle 12 reduces the tension with which the band 18 fastens said paper sheet bundle 12, thereby allowing for the easy removal of the band 18. The chord portion 18*a* of the band 18 which is fully separated from the bottom of the concave portion 12*b* of the paper sheet bundle 12 can be reliably caught by the hook 23*a* of the hooking member 23.

The hooking member 23 is reciprocated by, for example, a plunger type solenoid device 32 (FIG. 2). Obviously, said reciprocation may be effected by any other known suitable drive mechanism.

When the removal of the band 18 is brought to an end, the lower movable clamping member 22 is let to fall to the original position to release the clamped paper sheet bundle 12. The released paper sheet bundle 12 is urged from behind by the corresponding paired pushing pins 16, carried along the surface of the guide board 10, and then transported from the band-removing section 13 on to a backup board 34. During this transport, the paired pushing pins 16 are inserted into a pair of slots 35 formed in that edge of said backup board 34 which faces the band-removing section 13. At this time, the pushing pins 16 are elastically thrown down from the upright position to be set below the backup board 34. This backup board 34 which is generally positioned slightly lower than the guide board 10 allows for the smooth transport of the paper sheet bundle 12 from the band-removing section 13. A through hole 36 is drilled at the center of the backup board 34.

The paper sheet bundle 12 from which the band has been taken off is vertically lifted, until the surface of the paper sheet bundle 12 touches a detection lever 37. At this time, the left side of the paper sheet bundle as viewed from its traveling direction faces a vacuum suction type discharge roller 38. Where the shaft 39 of the discharge roller 38 is rotated in the direction of an indicated arrow F, then the paper sheets constituting a bundle are successively adsorbed to the peripheral surface of the discharge roller 38 by its suction force. Since, however, the discharge roller 38 is rotated with a greater force than the suction force, the paper sheets are successively carried away from the discharge roller 38 in the direction of an indicated arrow G.

Paper sheets successively removed from the bundle 12 by the above-mentioned backup board 34 and discharge roller 38 are delivered to the succeeding step of, for example, examination by means of a discharge mechanism 40 (not shown).

Where no paper sheet is left on the backup board 34, then the lower contact end portion of the detection lever 37 falls into the through hole 36. At this time, the rotation of the detection lever 37 causes a light path 43 extending between a light source 41 and photosensor 42 to be shut off by the upper end portion of said detection lever 37.

The photosensor 42 sends forth a signal denoting the absence of paper sheets from the surface of the detection lever 37. In response to the issue of said signal, the discharge roller 38 ceases to be rotated, and the backup board 34 falls to its original position, ready for the succeeding operation. The vertical movement of the backup board 34 may be carried out by any known suitable means such as an oil pressure cylinder or cam mechanism (not shown). Means for detecting the movement of the detection lever 37 may be formed of any other proper known device than described above.

As previously mentioned, paper sheet bundles 12 are successively brought to the band-removing section 13 for the automatic easy removal of the band. Moreover, the paper sheet bundle from which the band has been taken off is delivered to the discharge mechanism 40 without noticeably getting out of shape.

Figure 6:
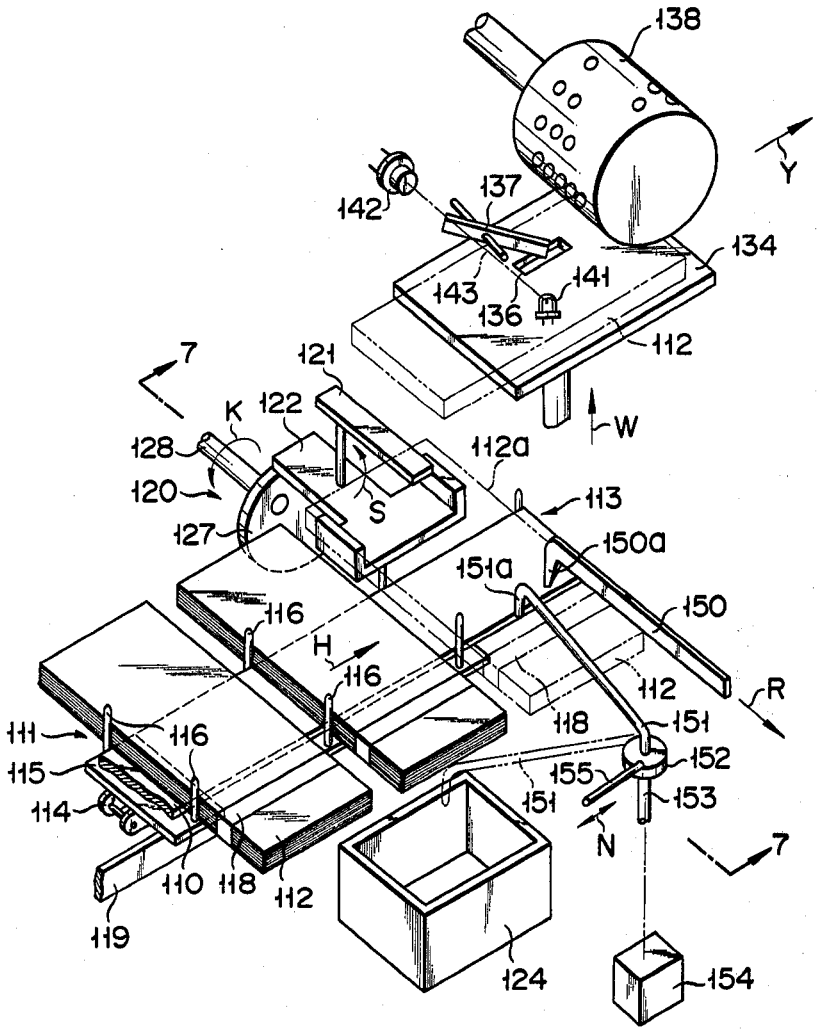
FIG. 6 is a schematic oblique view of a band-removing apparatus according to a second embodiment of the invention.
Figure 7:
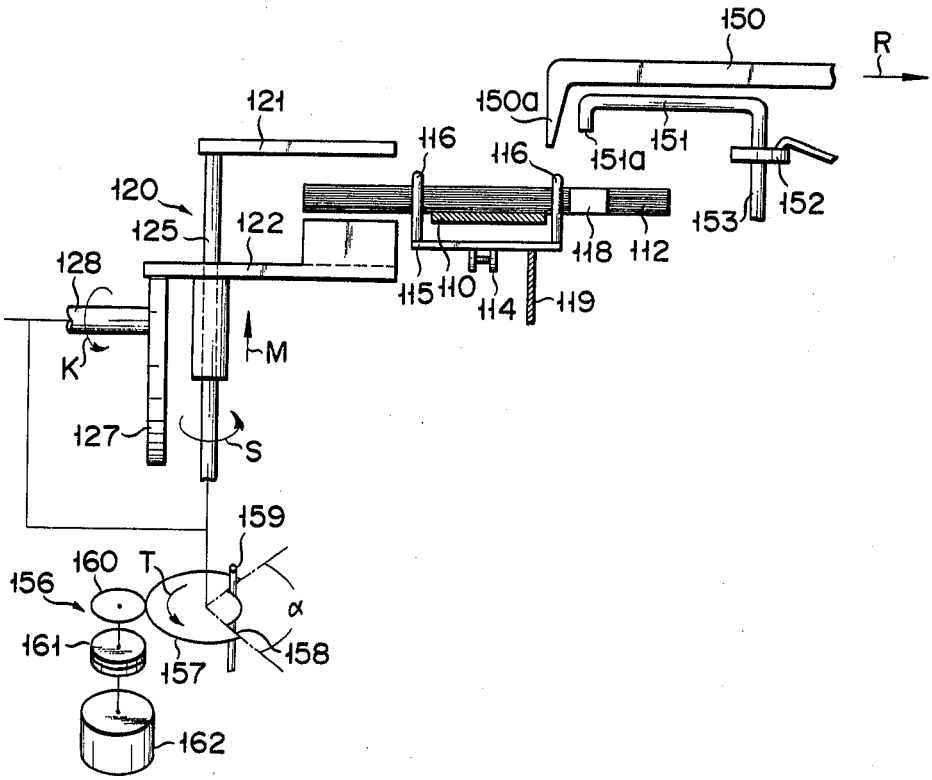
FIG. 7 is a cross sectional view on line 7—7 of FIG. 6, also showing a drive mechanism in the oblique form.

Description is now given with reference to FIGS. 6 and 7 a band-removing apparatus according to a second embodiment of this invention. The parts of the second embodiment are denoted by reference numerals obtained by adding a number of 100 to those of the parts of the first embodiment, detailed description thereof being omitted.

Also in the second embodiment, a plurality of paper sheet bundles 112 fastened by a band 118 are successively carried along the surface of the guide board 110 in the direction of an indicated arrow H by a pair of pushing pins 116 erected on the respective support brackets 115 to the band-removing section 113. A paper sheet bundle 112 brought to the band-removing section 113 is indicated in 2dots-dash lines. The respective support brackets 115 are mounted on the endless chain 114 and guided by a guide bar 119. A bending mechanism 120 which comprises a pair of upper and lower clamping members 121, 122 and is disposed on the lateral side of a transport passage 111 is operated in substantially the same manner as that of the first embodiment. The lower clamping member 122 is lifted to the clamping position from the indicated released position (FIG. 7) in the direction of an indicated arrow M, when an eccentric cam 127 is driven by the counterclockwise rotation of a shaft 128 in the direction of an indicated arrow K. As a result, the lower clamping member 122 clamps one end portion of the paper sheet bundle 112 in cooperation with the upper stationary bar-shaped clamping member 121. At this time, one end portion **112*a* of the paper sheet bundle 112 is bend downward to define a concave portion. As in the first embodiment, therefore, part of the band 118 is stretched over the concave portion of said bent paper sheet bundle 112** in the form of a chord.

A knifing member 150 and suction pipe 151 are provided on the opposite side of the transport passage 111 to the bending mechanism 120. A band receptacle 124 is disposed near said knifing member 150 and suction pipe 151. These knifing member 150 and suction pipe 151 act as band-removing means in place of the hooking member 23 of the first embodiment. The free downward bent end portion of the knifing member 150 acts as a knifing edge **150*a*. The knifing member 150 is made movable crosswise of the transport passage 111. Means for effecting said crosswise movement of the knifing member 150 may be formed of the plunger type solenoid 32** of the first embodiment or any other known proper device.

Like the hook **23*a* of the hooking member 23 of the first embodiment, the edge portion 150*a* is disposed slightly inwardly beyond the position of the band 118 of the paper sheet bundle 112**.

The free end portion of the suction pipe 151 is bent downward, causing a suction nozzle **151*a* to be generally set at a sucking position facing the band 118 of the paper sheet bundle 112. The suction pipe 151 is fixed to a rotary disc 152. The base end of the suction pipe 151 communicates with a vertical pipe shaft 153 whose lower end is connected to a suction drive source 154, which supplies a suction force to the suction pipe 151. One end of a drive wire 155 is connected to the rotary disc 152. Where the drive wire 155 is pushed or pulled in the direction of an indicated arrow N, then the disc 152 is turned through a prescribed angle. The rotation of the disc 152 causes the suction pipe 151 to swing between a suction position indicated in solid lines in FIG. 6 and a fallen position (indicated is 2 dots-dash lines) which faces a band receptacle 124**.

In the band-removing section 113, part of the band 118 wound about the downward bent paper sheet bundle 112 is stretched over the concave portion of the downward bent paper sheet bundle 112 in the form of a chord. The chord portion of the band 118 lies within the locus of the movement of the edge portion **150*a* of the knifing member 150. Where, therefore, the knifing member 150 is retracted in the direction of an indicated arrow R from its advanced position, then the edge 150*a* of said knifing member 150 cuts the chord portion of the band 118. The cut band 118 is adsorbed to the opening of a suction nozzle 151*a*. Where suction is stopped after the adsorption of the cut band 118 to the opening of the suction nozzle 151*a*, then the cut band 118 falls into the band receptacle 124. Since resistance applied to the cut band 118 is reduced, the cut band 118 can be easily taken into the band receptacle 124, even if the suction pipe 151** has a relatively small sucking force.

The paper sheet bundle 112 from which the band 118 has been taken off still remains clamped by the bending mechanism 120. As schematically shown in FIG. 7, a vertically extending shaft 125 can be rotated from the normal position through a prescribed angle of, for example, 90° in the direction of an indicated arrow S, together with the lower clamping member 122 and eccentric cam 127. The shaft-rotating mechanism 156 comprises, as shown in FIG. 7, a rotation control gear 157 connected to the rotatable shaft 125 and eccentric cam 127, stop 159 disposed in a segmental notch 158 formed in the rotation control gear 157, cogwheel 160 threadedly engaged with the rotation control gear 157 and reversible drive motor 162 connected to the cogwheel 160 by means of a friction clutch 161.

The rotation of the drive motor 162 causes the rotation control gear 157 to be rotated by means of the friction clutch 161 and cogwheel 160 through an angle $\alpha$ in the direction of an indicated arrow T from that end of the segmental notch 158 of the rotation control gear 157 in which the stop 159 was initially engaged with said gear 157. As a result, the stop 159 is engaged with the opposite end of the segmental notch 158 as shown in FIG. 7. Even while, therefore, the motor 162 continues to be driven, the control gear 157 retains its rotated position due to slipping taking place at the clutch 161. Where the motor 162 is reversibly driven, then the control gear 157 regains its original position by being rotated similarly through an angle $\alpha$. If the angle $\alpha$ is chosen to be 90°, then the shaft 125 is reciprocated by the aforesaid shaft-rotating mechanism 156 through said prescribed angle $\alpha$ of 90°.

The paper sheet bundle 112 from which the band has been taken off is discharged from the band-removing section by being rotated through an angle of 90° with one end of said paper sheet bundle still clamped. When rotated through an angle of 90°, then paper sheet bundle 112 has its lengthwise axis rendered parallel with the transport passage 111. During said rotation, the opposite end of the paper sheet bundle 112 draws a large segmental form. That portion of the band 118 which is wound about the proximity of that end of the paper sheet bundle 112 which is not clamped and later cut by the knifing member 150 is sucked by the suction pipe 151. In this case, the paper sheet bundle 112 is rotated in a direction opposite to that in which the suction pipe 151 is rotated, assuring the very effective separation of the cut band 118 from the paper sheet bundle 112.

A backup board 134 is brought below the 90°-rotated paper sheet bundle 112 to release it from the clamped condition. At this time, the paper sheet bundle 112 is placed on the backup board 134 without getting out of shape. Later, the backup board 134 is lifted as in the first embodiment in the direction of an indicated arrow W (FIG. 6) by proper drive means. The surface of the paper sheet bundle 118 now set on the drive means is pressed against the peripheral plane of a discharge roller 138. The paper sheets constituting the bundle 118 are carried away one after another from the discharge roller 138 in the direction of an indicated arrow Y, because said roller 138 is rotated with a greater force than its suction force.

The band-removing apparatus according to the second embodiment of FIGS. 6 and 7 comprises, like that of the first embodiment, a detection lever 137 for judging whether no paper sheet is left on the backup board 134, light source 141 for emitting a light 143 and photosensor 142.

In the second embodiment, the paper sheet bundle-bending mechanism 120 which is rotated by the shaft-rotating mechanism 156 is set on one lateral side of the transport passage 111, thereby leaving said passage always open. Therefore, the second embodiment offers a greater design lattitude of extending the guide board 110 and endless chain 114 beyond the band-removing section 113. Further, the paper sheet bundle 112 from which the band has been taken off is transported on to the backup board 134, while being rotated, thereby assuring the reliable separation of the band 118 from the paper sheet bundle 112. The paper sheet bundle 112 remains clamped, until it is transferred on to the backup board 134, and consequently is little likely to get out of shape. It is therefore unnecessary to provide any particular device for keeping the paper sheet bundle 112 in shape, before the paper sheets constituting the bundle 112 are carried away one after another from the discharge roller 138.

The paper sheet bundle-bending mechanism 20 of the first embodiment comprised an upper stationary clamping member 21 and lower movable clamping member 22. The paper sheet bundle-bending mechanism 120 of the second embodiment similarly comprised an upper stationary clamping member 121 and lower movable clamping member 122. Or both types of clamping members may be rendered movable.

What we claim is:

1. A band-removing apparatus for taking off a band wound about a paper sheet bundle comprising:

transport means for conducting a paper sheet bundle fastened by a band through a transport passage to a band-removing section;

means provided in the band-removing section to bend said paper sheet bundle around one axis thereof;

means for taking off the band from the bent paper sheet bundle; and means for carrying the paper sheet bundle from which the band has been taken off away from the band-removing section.

2. A band-removing apparatus for taking off a band wound about a paper sheet bundle crosswise of one axis thereof comprising:

transport means for conducting a paper sheet bundle fastened by a band through a transport passage to a band-removing section;

means provided in the band-removing section which bends said paper sheet bundle around one axis thereof, thereby causing part of the wound band to be stretched over the concave portion of the bent paper sheet bundle in the form of a chord;

means for taking off the band from the bent paper sheet bundle; and discharge means for carrying the paper sheet bundle from which the band has been taken off away from the band-removing section.

3. A band-removing apparatus for taking off a band wound about a paper sheet bundle crosswise of one axis thereof comprising:

transport means for conducting a paper sheet bundle fastened by a band through a transport passage to a band-removing section with the axis of said transported paper sheet bundle set substantially at right angles to a transport direction;

bending means which is provided in the band-removing section to clamp one end portion of the paper sheet bundle and bend said bundle around said one axis, thereby causing part of the wound band to be stretched over the concave portion of the bent paper sheet bundle in the form of a chord;

means for taking off the band from the bent paper sheet bundle by engaging with said part of the wound band to be stretched in the form of a chord; and discharge means for carrying the paper sheet bundle from which the band has been taken off away from the band-removing section.

4. The band-removing apparatus according to claim 1, 2 or 3, wherein the paper sheet bundle-bending means is disposed on one lateral side of the transport passage; and the band-removing means is set on the opposite lateral side of the transport passage in a state facing the paper sheet bundle-bending means.

5. The band-removing apparatus according to claim 4, further comprising a receptacle disposed on said opposite lateral side of the transport passage to receive a band taken off from the paper sheet bundle.

6. The band-removing apparatus according to claim 3, wherein the paper sheet bundle-bending means comprises a pair of clamping members which are made relatively movable in a vertical direction; one of said paired clamping members is provided with a pair of spatially arranged projections; and the other clamping member is constructed in the form of a bar, which is disposed intermediate between said paired projections.

7. The band-removing apparatus according to claim 1, 2 or 3, wherein the band-removing means comprises a hooking member which is made movable crosswise of the transport direction and whose free end portion constitutes a hook for pulling the band from the paper sheet bundle by engagement with said band.

8. The band-removing apparatus according to claim 1, 2 or 3, wherein the band-removing means comprises a knifing member whose free end portion constitutes a knifing edge for cutting the band by engagement therewith.

9. The band-removing apparatus according to claim 6, wherein the paper sheet bundle-bending means further comprises an eccentric cam for effecting the relative movement of the paired clamping members.

10. The band-removing apparatus according to claim 9, further comprising means for jointly rotating the paired clamping members of the paper sheet bundle-bending means around one vertical axis through a prescribed angle, thereby causing the paper sheet bundle to be transferred from the band-removing section to the discharge means in a state held by the paired clamping members.

11. The band-removing apparatus according to claim 8, wherein the band-removing means further comprises suction means for sucking the band cut by the knifing member.

12. The band-removing apparatus according to claim 11, wherein a band receptacle is provided on one lateral side of the transport passage; the free end of the suction means is provided with a suction nozzle; the base end of said suction means is fitted with a rotatable suction pipe; and the rotation of the suction pipe causes the cut and sucked band to be received in the receptacle.

* * * * *